United States Patent [19]

Kuribayashi

[11] Patent Number: 4,510,880

[45] Date of Patent: Apr. 16, 1985

[54] RUDDER ARRANGEMENT FOR SHIPS

[76] Inventor: Sadatomo Kuribayashi, 21-22,2-chome, Kakinokizaka, Tokyo 152, Japan

[21] Appl. No.: 473,789

[22] Filed: Mar. 10, 1983

[30] Foreign Application Priority Data

Mar. 24, 1982 [JP] Japan ..... 57-46208

[51] Int. Cl.[3] ..... B63H 25/38

[52] U.S. Cl. ..... 114/162; 114/167

[58] Field of Search ..... 114/162, 163, 165, 144 C, 114/167; 244/87, 90 R

[56] References Cited

U.S. PATENT DOCUMENTS 1,582,391 4/1926 Flettner ..... 114/163
1,661,114 2/1928 Flettner ..... 114/163
3,319,594 5/1967 Gianoli ..... 114/144 C
4,024,827 5/1977 Becker ..... 114/162

FOREIGN PATENT DOCUMENTS 266754 6/1927 United Kingdom ..... 114/163

*Primary Examiner*—Sherman D. Basinger
*Attorney, Agent, or Firm*—Anthony A. O'Brien

[57] ABSTRACT

A ship's rudder having a flap at its trailing end, actuating apparatus for such flap comprises a sector member which is mounted on the flap at top end thereof, extending toward a rudder stock and has teeth concentric with pivot pins mounting the flap on the rudder and engaged with teeth arranged concentrically with a rudder stock on a stationary guide member surrounding the rudder stock.

4 Claims, 6 Drawing Figures

RUDDER ARRANGEMENT FOR SHIPS

The present invention relates to a rudder arrangement for ships, more particularly a rudder arrangement for ships having a main rudder member provided with a flap member pivotally mounted thereon at trailing edge.

DESCRIPTION OF THE PRIOR ART

The prior art is generally cognizant of the rudder arrangement for ships having the main rudder member with its flap member pivotally mounted thereon at the trailing edge. Examples of such rudder arrangement are known in U.S. Pat. No. 4,307,677, German Patent Laying-open publication No. 2,656,738 and No. 2,709,666 and Japanese Patent Publication No. 20400/1973.

In U.S. Pat. No. 4,307,677, German Patent Laying-open Publication No. 2,656,738 and Japanese Patent Publication No. 20400/1973, each of flap members is provided with a driving mechanism mounted inside thereof. German Patent Laying-open Publication No. 2,709,666 reveals a driving means with a link mechanism mounted on top of the flap member, which link mechanism is connected to actuating means such as an electric motor, located within a hull structure at the aft end of ship. However, no prior art is known which utilizes a train of gears located between a driving shaft of the main rudder member and a pivot pin of the flap member in a level above both members.

SUMMARY OF THE INVENTION

The present invention is summarized in that a rudder arrangement for ships having a main rudder member rotatably mounted on hull structure and a flap member pivotally mounted on said main rudder member at the trailing edge thereof, comprises a horizontal sector member mounted on the flap member in a level above the top end of the main rudder member and having teeth concentric with vertical pivot pins mounting said flap member on said main rudder member, and a stationary horizontal guide member of U-shaped cross-section located at the same level as said sector member and having an open end of an U-shaped sector member fixedly mounted on a support member depending from the hull structure with a rudder shaft embraced in the opening of the U-shape and provided at the closed end of the U-shape with teeth concentric with the rudder shaft in mesh with those of the sector member.

An object of the present invention is to construct a marine rudder with a flap member having a number of components located in a restricted space between the hull structure and top end of the rudder, which space is made as small as possible so as to simplify the whole structure and minimize the cost of construction and maintenance.

Another object of the present invention is to construct a marine rudder with a flap member operating smoothly without using any actuating means connected to a power source, such as electric motors or hydraulic systems, particularly for driving the flap member relatively to the main rudder member.

Still another object of the present invention is to construct a marine rudder with a flap member having a driving mechanism for the flap member assembled together easily by using a number of rather small-sized gears even when the size of the main rudder is substantially increased.

Still another object of the present invention is to construct a marine rudder with a flap member which is compact and free from intricate fittings precluding the inspection thereof.

Other objects, advantages and features of the invention will be apparent from the following description of the preferred embodiment taken in conjunction with the accompanying drawings.

DESCRIPTION OF THE PREFERRED EMBODIMENTS

Figure 1:
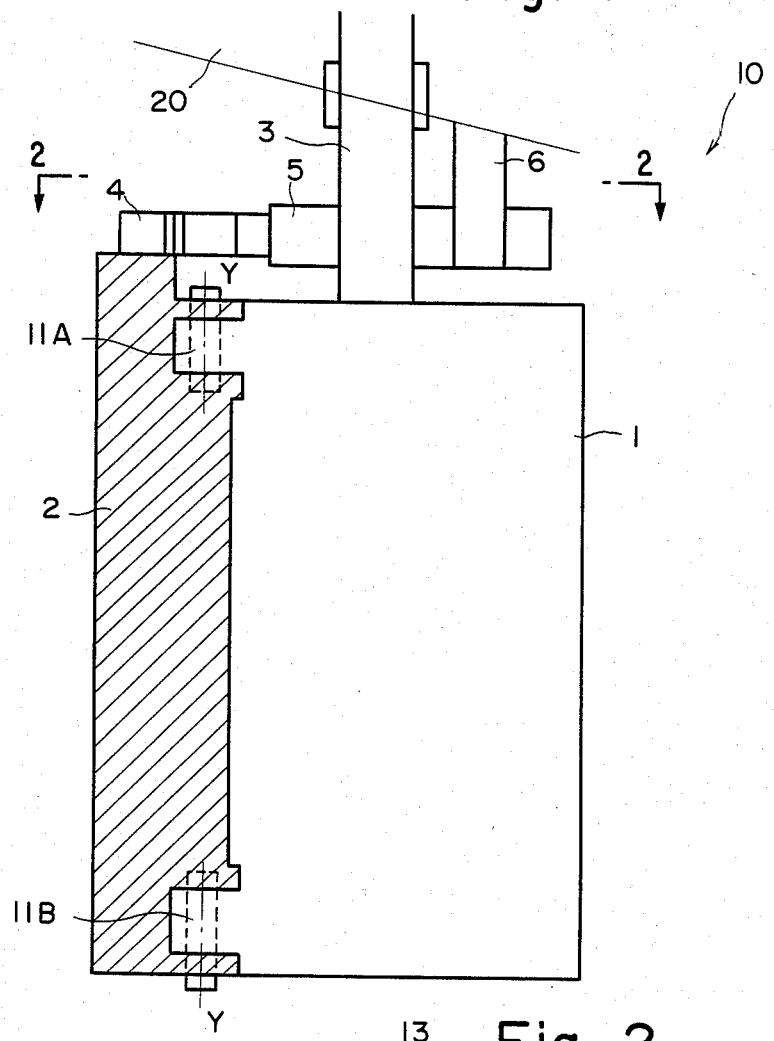
FIG. 1 is a side elevation view showing the rudder arrangement according to the present invention.
Figure 2:
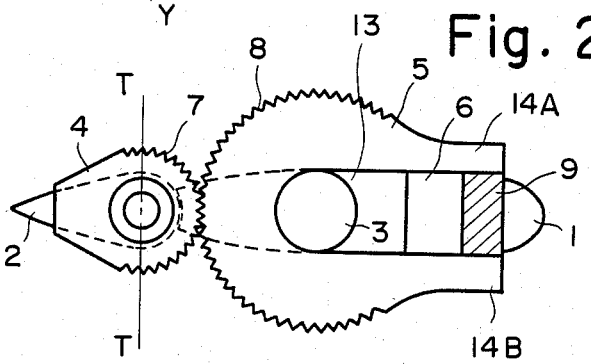
FIG. 2 is a plan view taken along a line II—II in FIG. 1.

Referring to FIG. 1, there is shown a rudder 10 according to the present invention, comprising a main rudder member 1 rotatably mounted on hull structure 20 by means of a rudder shaft or stock 3, and a flap member 2 pivotally mounted on the main rudder member along the trailing edge thereof. The main rudder member 1 is suspended from the hull structure 20. The flap member 2 is mounted on the main rudder member 1 by means of a pair of pivot pins 11A, 11B, which are located adjacent to the top and the bottom end of the main rudder member 1. A center line of the pair of pivot pins 11A, 11B is placed parallel to that of the rudder shaft 3. As shown in FIG. 2, the main rudder member 1 and the flap member 2 are shaped such that cross-sections of both members 1 and 2 will form a complete aerofoil section when assembled together.

The top end of the flap 2 is placed in a level higher than the top end of the main rudder 1. A sector member 4 mounted at the left end of rudder 1 on the top end of the flap member 2, extends horizontally toward the rudder shaft 3 with its right end placed forwardly beyond the pivot pin 11A. As shown in FIG. 2, the sector member 4 is shaped semi-circular at its right end, which has a center of circle on a vertical center line axis YY of pivot pins 11A, 11B. More particularly, the sector member 4 has a semi-circular shape on its right side or forward side of vertical transverse plane TT passing the center line YY of the pivot pin 11A and is provided on this portion with teeth 7 of a spur wheel. The sector member 4 has a wedge-shaped configuration on the left side of the vertical transverse plane TT with its width decreased gradually. The sector member 4 is provided with a circular opening 12 immediately above the pivot pin 11A enabling the same to be passed therethrough for servicing.

A horizontal U-shaped guide member 5 embraces the rudder shaft 3 in the opening 13 of the U between its two leg portions 14A, 14B which extend rightwardly or forwardly. Further, the guide member 5 is fitted over a lower end of support member 6 depending from the hull structure 20 adjacent to the rudder shaft 3 with the support member 6 between the pair of leg portions 14A, 14B, thereby supporting the guide member 5 in a predetermined position. A suitable filler member 9 is inserted between the pair of leg portions 14A, 14B on the right side of the support member 6. The guide member 5 is provided on its left half portion with teeth 8 of a spur wheel concentric with the rudder shaft 3, with which teeth 8 and the teeth 7 of the sector member 4 will be brought into engagement.

Figure 3:
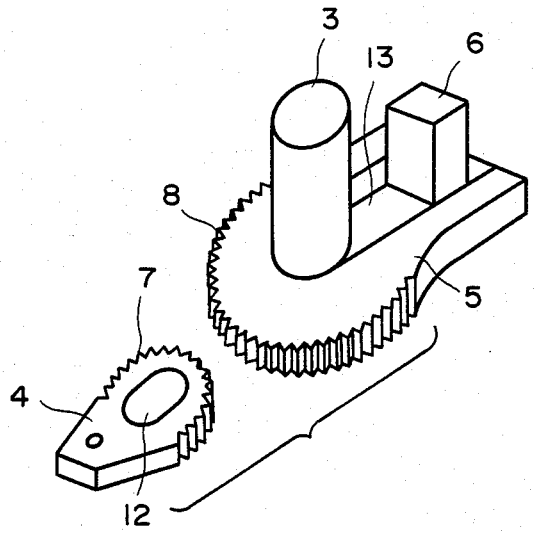
FIG. 3 is a perspective view showing essential parts of the rudder in FIG. 1.

As shown in FIG. 3, the guide member 5 is a stationary horizontal member mounted on the support member 6 at lower end thereof depending from the hull structure 20 and the rudder shaft 3 will be rotated in the opening 13 of the guide member 5.

Figure 4:
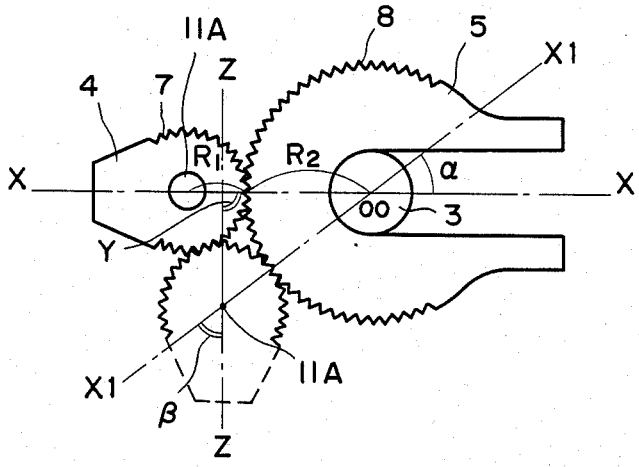
FIG. 4 is a plan view showing the operation of the rudder in FIG. 1.

As shown in FIGS. 2 and 4, the main rudder member 1 and the flap member 2 are assumed to have been initially in a fore and aft vertical plane XX passing through the center line 00 of the rudder stock 3; then pivot pins 11A, 11B will be placed in a vertical plane $X_1X_1$ which is at an angle $\alpha$ with respect to the fore and aft vertical plane XX passing through the center line 00 of the rudder shaft 3, if the rudder shaft 3 is rotated by an angle of $\alpha$ when steering. Hence, the sector member 4 will be rotated onto the phantom line position (FIG. 4) from full line position by action of teeth 7 thereof engaged with teeth 8 of the guide member 5. Since the sector member 4 is fixedly mounted on the flap member 2, an angle between the flap member 2 and the main rudder member 1 which is swung around by an angle of $\alpha$, will be equal to an angle $\beta$ between the vertical plane $X_1X_1$ in which the main rudder member 1 is placed and a vertical plane ZZ in which the sector member 4 is placed. The vertical plane ZZ, in which the flap member 2 is placed when the main rudder member 1 is swung by the angle of $\alpha$, will form an angle of $\gamma$ with respect to the vertical plane XX in which the main rudder member 1 and the flap member 2 had been placed initially before steering. Assuming that diameters of both spur wheels having teeth 7 and 8 are $R_1$ and $R_2$ respectively, a ratio $R_1/R_2=35/55$, and the angle $\alpha$ will be 35 degrees, and the angle $\gamma$ will be 90 degrees.

Figure 5:
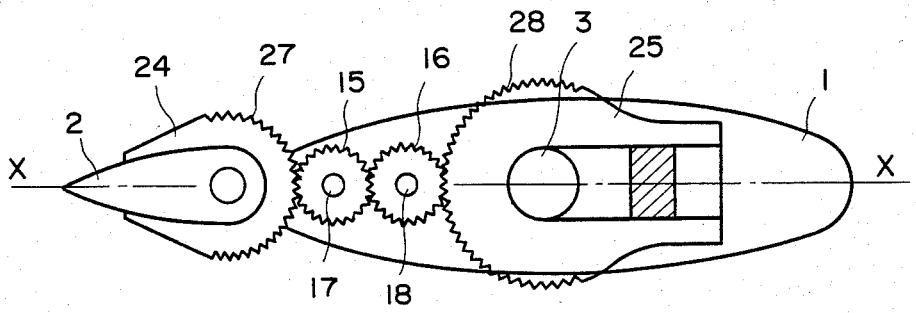
FIG. 5 is a plan view showing a modification of the embodiment in FIG. 1.

FIG. 5 shows a modification of the embodiment in FIG. 1, in which a pair of mutually engaged spur wheels 15 and 16 are provided on the main rudder member 1 at the top end thereof. Vertical center lines of spur wheels 15, 16 are located in the fore and aft vertical center line plane XX with the spur wheel 15 engaged with the teeth 27 of sector member 24 and with the spur wheel 16 engaged with the teeth 28 of guide member 25. 17 and 18 denote a pair of vertical pins supporting both spur wheels 15 and 16 respectively on the top end of the main rudder member 1. This modification will serve to reduce the size of the sector member 4 and the guide member 5 in case of fabricating a substantially large-sized rudder, and will operate in the same manner as the rudder arrangement in FIG. 1.

Figure 6:
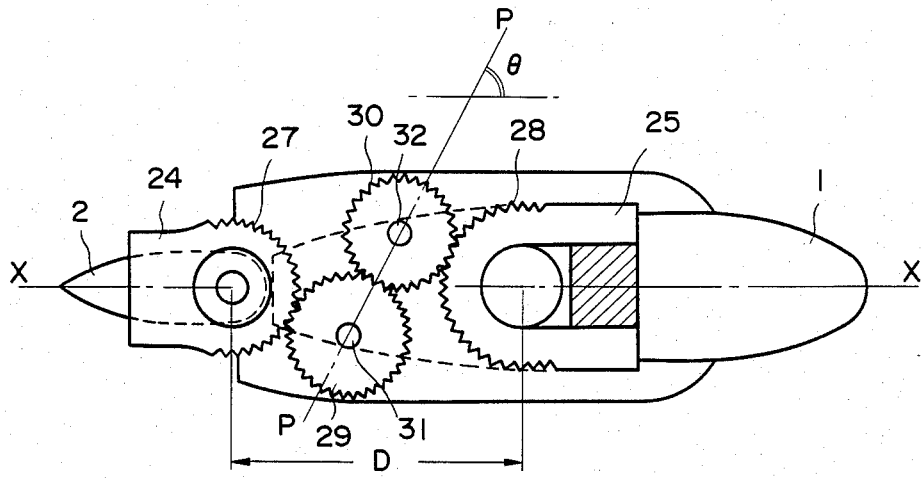
FIG. 6 is a plan view showing another modification of the embodiment in FIG. 1.

FIG. 6 shows another modification of the embodiment in FIG. 1, in which a pair of mutually engaged spur wheels 29, 30 are provided on the main rudder member 1 at the top end thereof. A vertical center line of both spur wheels 29, 30 is located in a vertical plane PP at an angle $\theta$ with respect to the fore and aft vertical center line plane XX, with the spur wheel 29 engaged with the sector member 24 and with the spur wheel 30 engaged with the guide member 25. This embodiment will serve to prevent both spur wheels 15 and 16 in the modification in FIG. 5 from becoming excessively small, and also serve to enable a pair of mutually engaged spur wheels 29 and 30 of standard size to be used at all times between the sector member 4 and the guide member 5 by regulating the angle of $\theta$ even though a distance D between the rudder stock 3 and the pivot pins 11A, 11B is changed. 31, 32 denote a pair of vertical pins supporting both spur wheels 29 and 30 respectively on the top end of the main rudder member 1. This modification will operate in the same manner as the rudder arrangement in FIG. 1.

As described hereinabove, according to the present invention, only a single piece of sector member 4 or a sector member 24 together with a pair of small intermediate wheels in case of large-sized rudders, are provided as a moving part in a very restricted space between the hull structure and the top end of the main rudder member, and hence the cost of construction and maintenance will be considerably reduced and will improve the reiliability of operation.

What is claimed is:

1. A rudder arrangement adapted to be mounted on the hull of a ship comprising:

a rudder having a top end and a trailing edge, a shaft depending from the hull and being connected to said rudder for rotatably driving the same, a flap member disposed adjacent the trailing edge of said rudder, pivot pin means aligned on a vertical axis and pivotably mounting said flap member on said rudder, a support member depending from the hull in spaced relation to said shaft, a guide member having a generally U-shaped defined by a pair of spaced leg portions joined by an arcuate section, said shaft extending through said guide member between said leg portions and adjacent said arcuate section, said guide member being fixed to said support member in engagement with said leg portions whereby said guide member is rendered stationary, a plurality of drive teeth on the periphery of the arcuate section of said guide member, a sector member fixedly mounted on a top portion of said flap member for unitary movement therebetween, said sector member having a semi-circular periphery facing the periphery of the arcuate section of said guide member, and interconnecting means between said semi-circular periphery and the teeth on said arcuate section to cause actuation of said flap member.

2. A rudder arrangement as claimed in claim 1 wherein said interconnecting means includes a set of teeth on said semi-circular periphery meshing with the teeth on said arcuate section.

3. A rudder arrangement as claimed in claim 1 wherein said interconnecting means includes a set of teeth on said semi-circular periphery, a first spur wheel engaging said set of teeth, a second spur wheel engaging said first spur wheel and the teeth on said arcuate section, and the center of said shaft and centers of said first and second spur wheels are located in a common fore-and-aft vertical plane.

4. A rudder arrangement as claimed in claim 1 wherein said interconnecting means includes a set of teeth on said semi-circular periphery, a first spur wheel engaging said set of teeth, a second spur wheel engaging said first spur wheel and the teeth on said arcuate section, and the center of said shaft being located in a fore-and-aft vertical plane with centers of said first and second spur wheels being located in a common vertical plane oblique to the fore-and-aft vertical plane of the spur wheels.

* * * * *